US008073184B2

(12) United States Patent
Horigome et al.

(10) Patent No.: US 8,073,184 B2
(45) Date of Patent: Dec. 6, 2011

(54) SPEAKER DEVICE

(75) Inventors: Minoru Horigome, Tendo (JP); Michiro Matsuda, Tendo (JP); Hiroshi Sato, Tendo (JP)

(73) Assignees: Pioneer Corporation, Tokyo (JP); Tohoku Pioneer Corporation, Yamagata (JP)

( * ) Notice: Subject to any disclaimer, the term of this patent is extended or adjusted under 35 U.S.C. 154(b) by 439 days.

(21) Appl. No.: 12/514,872

(22) PCT Filed: Nov. 17, 2006

(86) PCT No.: PCT/JP2006/323033

§ 371 (c)(1), (2), (4) Date: May 14, 2009

(87) PCT Pub. No.: WO2008/059599

PCT Pub. Date: May 22, 2008

(65) Prior Publication Data

US 2010/0086168 A1 Apr. 8, 2010

(51) Int. Cl.
*H04R 1/02* (2006.01)

(52) U.S. Cl. ..... 381/386; 381/394; 381/409

(58) Field of Classification Search ..... 381/386, 381/394, 409

See application file for complete search history.

(56) References Cited

U.S. PATENT DOCUMENTS 6,438,249 B1 * 8/2002 Wiener ..... 381/388

FOREIGN PATENT DOCUMENTS

| | | |
|---|---|---|
| JP | 59-11599 | 1/1984 |
| JP | 59-63593 | 4/1984 |
| JP | 08-098296 | 4/1996 |
| JP | 08-140186 | 5/1996 |
| JP | 2000-152395 | 5/2000 |
| JP | 2002-142284 | 5/2002 |

* cited by examiner

*Primary Examiner* — Tu-Tu Ho

(74) *Attorney, Agent, or Firm* — Young & Thompson

(57) ABSTRACT

In a speaker device, cutting wiring electrically connected to a conductive wire of an electronic component and a voice coil, and the conductive wire and the wiring are electrically connected without a speaker terminal lug. The speaker device includes wiring electrically connected to the voice coil, an electronic component having a component wire, and a frame. The frame has a conductive wire fixing part for fixing the conductive wire, and the conductive wire is fixed to the conductive wire fixing part to be directly connected to the wiring. Thereby, even if a vibration is transmitted to the frame at the time of driving the speaker device, the conductive wire never vibrates, and the conductive wire does not pull the wiring. Therefore, the conductive wire and wiring are not cut. Also, since the conductive wire is the speaker terminal lug, cost of the speaker device can be reduced.

15 Claims, 7 Drawing Sheets

SPEAKER DEVICE

TECHNICAL FIELD

The present invention relates to a wiring configuration of a speaker device.

BACKGROUND TECHNIQUE

Conventionally, there is known a speaker device having a wiring configuration of electrically connecting a tinsel cord electrically connected to a lead wire of a voice coil or the voice coil and wiring drawn from an amplifier via a terminal lug for a speaker device.

In the speaker device having the wiring configuration, the lead wire of the electronic component having such a function is sometimes electrically connected to the terminal lug for the speaker device in order to control a frequency component of a sound signal inputted to the voice coil via the wiring of the amplifier (see Patent References-1 to 3, for example). As the electronic component, there are a capacitor, a coil, a resistor and the like.

In the speaker device according to Patent References-1 to 3, a capacitor is mounted on a capacitor mounting part provided on a frame or a storage part provided in a connector, and the lead wire of the capacitor is electrically connected to a tinsel cord via the terminal lug for the speaker device. In Patent References-1 and 2, the capacitor mounting part is referred to as "clamp part" and "mounting part", and the terminal lug for the speaker device is referred to as "terminal" and "terminal board", respectively.

Namely, the terminal lug for the speaker device is provided in the speaker device, and the lead wire of the capacitor and the lead wire or the tinsel cord of the voice coil are not directly connected.

In a speaker device according to Patent Reference-4, the above-mentioned electronic component (referred to as "network electronic component" in Patent Reference-4) is provided, and a protective cover to which the electronic component is fixed is mounted on a back side of the frame (i.e., on a side reverse to an acoustic radiation side).

Patent Reference-1: Japanese Patent Application Laid-open under No. H08-140186

Patent Reference-2: Japanese Patent Application Laid-open under No. 2000-152395

Patent Reference-3: Japanese Patent Application Laid-open under No. H08-98296

Patent Reference-4: Japanese Patent Application Laid-open under No. 2002-142284

DISCLOSURE OF INVENTION

Problem to be Solved by the Invention

In the above-mentioned speaker device according to Patent References-1 to 3, the terminal lug for the speaker device is provided in order to electrically connect the lead wire of the capacitor and the tinsel cord. Thus, the cost of the speaker device problematically increases by the cost of the additional terminal lug.

Additionally, in the speaker device, the capacitor, inserted into an insertion hole of the capacitor mounting part, is mounted on the capacitor mounting part. Therefore, the capacitor is not so strongly fixed to the capacitor fixing part. Thus, the speaker device of this kind has problems, which will be described now. Namely, if a vibration occurring at the time of driving the speaker device is transmitted to the capacitor via the frame, the capacitor vibrates due to the vibration, and the capacitor considerably moves with respect to a predetermined mounting position of the capacitor mounting part or slips with respect to the capacitor mounting part. At this time, the capacitor pulls the lead wire of the capacitor. Thereby, the lead wire of the capacitor is problematically cut. Further, an external force operates on the connection part of the lead wire of the capacitor and the tinsel cord, and the joint part breaks. As a result, the lead wire of the capacitor and the tinsel cord may be problematically cut.

In view of these problems, if the lead wire of the capacitor and the wiring (the tinsel cord or the lead wire of the voice coil) electrically connected to the voice coil can be directly connected, it becomes unnecessary to provide the terminal lug for the speaker device. Therefore, the increase in the cost of the speaker device can be prevented.

However, when the configuration is employed, the vibration occurring at the time of driving the speaker device is transmitted to the capacitor via the frame, and the lead wire of the capacitor pulls the wiring electrically connected to the voice coil. Thereby, the lead wire of the capacitor and the wiring electrically connected to the voice coil are problematically cut, and the joint part of the lead wire of the capacitor and the wiring electrically connected to the voice coil and the connection part of the voice coil and the wiring electrically connected to the voice coil are problematically cut. So as to solve these problems, it is thought that a lead wire fixing part for fixing the lead wire of the capacitor is further provided, and the lead wire of the electronic component is fixed.

The present invention has been achieved in order to solve the above problems. It is an object of this invention to provide a speaker device having a wiring configuration capable of preventing cut of wiring electrically connected to a conductive wire of an electronic component and a voice coil and capable of electrically connecting the conductive wire of the electronic component and the wiring electrically connected to the voice coil without a speaker terminal lug.

In the invention according to claim 1, a speaker device includes: wiring electrically connected to a voice coil; an electronic component having a conductive wire; and a supporting body for supporting the voice coil and the electronic component, wherein the supporting body has a conductive wire fixing part for fixing the conductive wire of the electronic component, wherein the conductive wire of the electronic component is fixed to the conductive wire fixing part of the supporting body to be directly connected to the wiring of the voice coil.

BRIEF DESCRIPTION OF THE REFERENCE NUMBER

Figure 1B:
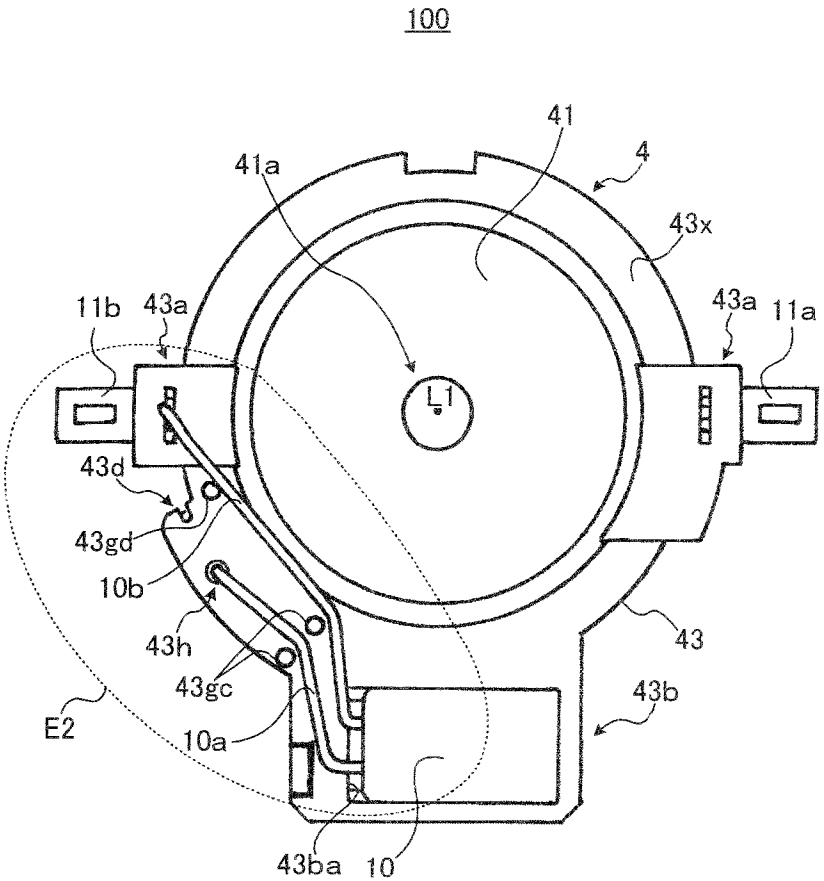
FIGS. 1A and 1B are a perspective view and a rear view of a speaker device according to an embodiment of the present invention.

4 Frame
43 Flange part
43*b* Capacitor fixing part (Electronic component fixing part)
43*d* Groove
43*ga* First lead wire guide part (First conductive wire guide part)
43*gb* Second lead wire guide part (Second conductive wire guide part)
43*gc* Bent part
43*h* Insertion hole
43*k* Lead wire fixing part (Conductive wire fixing part)
6 Voice coil
6*a* and 6*b* Lead wires (Wiring)
10 Capacitor (Electronic component)
10*a* and 10*b* Lead wires (Conductive wires)
10*aa* End portion
30 Magnetic circuit
31 Vibration body
70 Solder
80 Jig
100 Speaker device

DETAILED DESCRIPTION OF THE PREFERRED EMBODIMENTS

According to one aspect of the present invention, there is provided a speaker device, including: wiring electrically connected to a voice coil; an electronic component having a conductive wire; and a supporting body for supporting the electronic component, wherein the supporting body has a conductive wire fixing part for fixing the conductive wire of the electronic component, wherein the conductive wire of the electronic component is fixed to the conductive wire fixing part of the supporting body to be directly connected to the wiring.

The above speaker device includes the wiring electrically connected to the voice coil, the electronic component having the conductive wire (hereinafter referred to as "lead wire"), and the supporting body for supporting the electronic component. The wiring electrically connected to the voice coil is the lead wire of the voice coil or the tinsel cord electrically connected to the lead wire of the voice coil. In addition, "electronic component" is the capacitor, the coil and the resistor, for example. The electronic component controls the frequency component of the sound signal inputted to the voice coil via wiring (not shown) of the amplifier, and adjusts the input level of the sound signal.

Particularly, in the speaker device, the supporting body has the conductive wire fixing part for fixing the conductive wire of the electronic component, and the conductive wire of the electronic component is fixed to the conductive wire fixing part of the supporting body to be directly connected to the wiring.

Thereby, even if the vibration is transmitted to the supporting body at the time of driving the speaker device, the conductive wire of the electronic component never vibrates or moves. Therefore, it can be prevented that the conductive wire of the electronic component pulls the wiring of the voice coil. Hence, it can be prevented that the conductive wire of the electronic components and the wiring of the voice coil are cut. In addition, since the wiring of the voice coil is never pulled on the side of the conductive wire of the electronic component, it can be prevented that the voice coil is pulled on the side of the conductive wire of the electronic component. Therefore, at the time of driving the speaker device, it can be prevented that the movement (the vibration occurring in the case that the sound current is inputted) of the voice coil is prevented.

By the configuration, the conductive wire of the electronic component serves as the speaker terminal lug. Thus, the conductive wire of the electronic component and the wiring of the voice coil can be electrically connected without the speaker terminal lug included in the above-mentioned speaker device according to Patent References-1 to 3. Thereby, the cost of the speaker device can be reduced by the cost of the additional terminal lug.

In a manner of the above speaker device, the supporting body may include plural electronic component fixing parts for fixing the electronic component, and the electronic component may be fixed to the electronic component fixing part.

Thereby, even if the vibration is transmitted to the supporting body at the time of driving the speaker device, the electronic component never pulls the conductive wire of the electronic component. Therefore, the conductive wire of the electronic component never vibrates or moves. Thereby, it can be prevented that the conductive wire of the electronic component pulls the wiring of the voice coil. Therefore, it can be prevented that the conductive wire of the electronic component and the wiring of the voice coil are cut.

In another manner of the above speaker device, a first conductive wire guide part for guiding the wiring of the electronic component to the conductive wire fixing part may be provided between the electronic component fixing part and the conductive wire fixing part. The conductive wire fixing part may have: an insertion hole for inserting the conductive wire; a groove for fixing a end portion of the conductive wire; and a second conductive wire guide part, provided between the insertion hole and the groove, for guiding the conductive wire from the insertion hole to the groove. The insertion hole and the groove may sandwich the second conductive wire guide part to be arranged opposite to each other. The conductive wire drawn from the electronic component may be guided to the insertion hole along a back surface of the first conductive wire guide part positioned in a direction reverse to the acoustic radiation direction; may be bent in the acoustic radiation direction to be inserted to the insertion hole; may be drawn to a surface of the second conductive wire guide part positioned in the acoustic radiation direction; and may be guided to the groove along the surface of the second conductive wire guide part. The end portion of the conductive wire may be bent in the direction reverse to the acoustic radiation direction to be fixed into the groove.

In this manner, the first conductive wire guide part for guiding the conductive wire of the electronic component to the conductive wire fixing part is provided between the electronic component fixing part and the conductive wire fixing part. Then, the conductive wire fixing part has: the insertion hole for inserting the conductive wire of the electronic component; the groove for fixing the end portion of the conductive wire of the electronic component; and the second conductive wire guide part, provided between the insertion hole and the groove, for guiding the conductive wire of the electronic component from the insertion hole to the groove. In addition, the insertion hole and the groove sandwich the second conductive wire guide part to be arranged opposite to each other.

The conductive wire drawn from the electronic component is guided to the insertion hole along the back surface of the first conductive wire guide part positioned in the direction reverse to the acoustic radiation direction; is bent in the acoustic radiation direction to be inserted to the insertion hole; is drawn to the surface of the second conductive wire guide part positioned in the acoustic radiation direction; and is guided to the groove along the surface of the second conductive wire guide part. The end portion of the conductive wire of the electronic component is bent in the direction reverse to the acoustic radiation direction to be fixed into the groove. In a preferred example, the wiring is directly and electrically connected to the conductive wire of the electronic component drawn to the surface of the second conductive wire guide part.

Therefore, the conductive wire of the electronic component is fixed by the insertion hole and the groove provided at the position opposite to the insertion hole with sandwiching the second lead wire guide part. Thereby, even if the vibration is transmitted to the supporting body at the time of driving the speaker device, the conductive wire of the electronic component never vibrates or moves. Thus, it can be prevented that the conductive wire of the electronic component pulls the wiring of the voice coil. Therefore, it can be prevented that the conductive wire of the electronic component and the wiring of the voice coil are cut.

In still another manner of the above speaker device, a projecting bent part for bending the conductive wire of the electronic component in a predetermined direction may be provided on a back surface of the electronic component fixing part positioned in the direction reverse to the acoustic radiation direction or on the back surface of the first conductive wire guide part, and the conductive wire drawn from the electronic component may be bent in a direction of the insertion hole at the projecting bent part to be guided to the insertion hole along the back surface of the first conductive wire guide part.

In this manner, the projecting bent part for bending the conductive wire of the electronic component in the predetermined direction is provided on the back surface of the electronic component fixing part positioned in the direction reverse to the acoustic radiation direction or on the back surface of the first conductive wire guide part. The conductive wire drawn from the electronic component is bent in the direction of the insertion hole at the projecting bent part, and is guided to the insertion hole along the back surface of the first conductive wire guide part. Thereby, in some shapes of the supporting body, even when the conductive wire drawn from the electronic component, straightly extending, cannot be guided to the insertion hole because of possibility of short circuit with the conductive wire, it becomes possible that the conductive wire drawn from the electronic component is bent in the direction of the insertion hole by the projecting bent part, and is rounded to be securely guided into the insertion hole. Additionally, in this manner, the conductive wire drawn from the electronic component contacts the bent part to be bent. Therefore, by dispersing the vibration energy transmitted from the supporting body to the bent part, it can be suppressed that the vibration energy is transmitted to the electronic component fixing part. Also, it can be suppressed that the electronic component slips from the electronic component fixing part.

In still another manner of the above speaker device, the electronic component may have a pair of conductive wires; a pair of projecting bent parts for bending the conductive wire of the electronic component in a predetermined direction may be provided on the back surface of the electronic component fixing part positioned in the direction reverse to the acoustic radiation direction or on the back surface of the first conductive wire guide part; and the pair of conductive wires drawn from the electronic component may be bent in the predetermined direction at the pair of projecting bent parts, respectively.

In this manner, the electronic component has the pair of conductive wires. The pair of projecting bent parts for bending the conductive wire of the electronic component in the predetermined direction are provided on the back surface of the electronic component fixing part positioned in the direction reverse to the acoustic radiation direction or on the back surface of the first conductive wire guide part. The pair of conductive wires drawn from the electronic component are bent in the predetermined direction at the pair of projecting bent parts, respectively. Therefore, it can be prevented that the short circuit occurs between the wiring of the voice coil and the conductive wire of the electronic component by the pair of projecting bent parts provided with the predetermined space.

In still another manner of the above speaker device, the conductive wire fixing part may have a conductive wire fixing hole, penetrating in the acoustic radiation direction, for fixing the bent conductive wire of the electronic component. A conductive wire supporting part, having a step-state cross-section and supporting the end portion of the conductive wire, may be provided in the conductive wire fixing hole. The conductive wire drawn from the electronic component may be guided to the conductive wire fixing hole along the back surface of the electronic component fixing part positioned in the direction reverse to the acoustic radiation direction; may be bent in the acoustic radiation direction to be inserted to the conductive wire fixing hole; and may be arranged into the conductive wire fixing hole to form a projecting shape in the acoustic radiation direction. The end portion of the conductive wire may be supported by the conductive wire supporting part in the conductive wire fixing hole. The conductive wire arranged in the conductive wire fixing hole may be fixed by the conductive wire supporting part and a surface opposite to the conductive wire supporting part. The conductive wire of the electronic component positioned in the acoustic radiation direction may be directly connected to the wiring of the voice coil at a position corresponding to the conductive wire fixing hole.

In this manner, the conductive wire fixing part has the conductive wire fixing hole, penetrating in the acoustic radiation direction, for fixing the bent conductive wire of the electronic component. The conductive wire supporting part, having the step-state cross-section and supporting the end portion of the conductive wire of the electronic component, is provided in the conductive wire fixing hole.

The conductive wire drawn from the electronic component is guided to the conductive wire fixing hole along the back surface of the electronic component fixing part positioned in the direction reverse to the acoustic radiation direction; is bent in the acoustic radiation direction to be inserted to the conductive wire fixing hole; and is arranged into the conductive wire fixing hole to form the projecting shape in the acoustic radiation direction. The end portion of the conductive wire of the electronic component is supported by the conductive wire supporting part in the conductive wire fixing hole. The conductive wire of the electronic component arranged in the conductive wire fixing hole is fixed by the conductive wire supporting part and the surface opposite to the conductive wire supporting part. The conductive wire of the electronic component positioned in the acoustic radiation direction is directly connected to the wiring of the voice coil at the position corresponding to the conductive wire fixing hole.

Thereby, even when the space for fixing the conductive wire at the supporting body is not so enough, the conductive wire of the electronic component can be securely fixed into the conductive wire fixing hole.

By the configuration, the conductive wire of the electronic component serves as the speaker terminal lug. Therefore, the conductive wire of the electronic component and the wiring of the voice coil can be electrically connected without the speaker terminal lug included in the above-mentioned speaker device according to Patent References-1 to 3. Thereby, the cost of the speaker device can be reduced by the cost of the additional terminal lug.

By the configuration, even if the vibration is transmitted to the supporting body at the time of driving the speaker device, the conductive wire of the electronic component never vibrates or moves. Thus, it can be prevented that the conductive wire of the electronic component pulls the wiring of the voice coil. Therefore, it can also be prevented that the conductive wire of the electronic component and the wiring of the voice coil are cut. In addition, since the wiring of the voice coil is never pulled on the side of the conductive wire of the electronic component, it can be prevented that the voice coil is pulled on the side of the conductive wire of the electronic component. Therefore, at the time of driving the speaker device, it can be suppressed that the appropriate movement of the voice coil is prevented.

In still another manner of the above speaker device, a connection part between the conductive wire of the electronic component and the wiring of the voice coil may be soldered. Thereby, the wiring of the voice coil can be securely electrically connected to the conductive wire of the electronic component.

In still another manner of the above speaker device, the conductive wire of the electronic component positioned in the insertion hole and/or the groove may be fixed via an adhesive applied to the insertion hole and/or the groove. Thereby, the joint force of the insertion hole of the supporting body and/or the groove and the conductive wire of the electronic component can be enhanced.

In still another manner of the above speaker device, the supporting body may be made by a resin material. Thereby, forming the supporting body becomes easy.

EMBODIMENT

Now, a description will be given of a preferred embodiment of the present invention with reference to attached drawings.

[Configuration of Speaker Device]

First, a configuration of a speaker device 100 will be explained with reference to FIGS. 1A and 1B and FIG. 2.

Figure 1A:
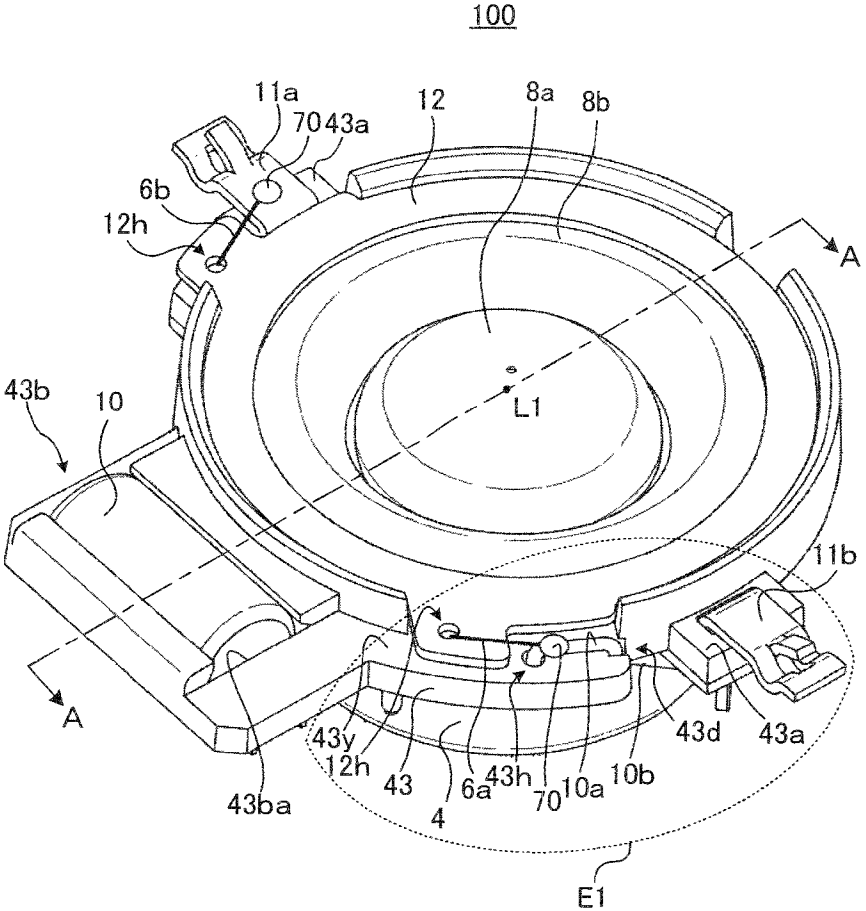

FIG. 1A shows a perspective view of the speaker device 100 according to an embodiment of the present invention. FIG. 1B shows a rear view of the speaker device 100 in such a case that it is observed from a direction reverse to an acoustic radiation direction Y1. FIG. 2 shows a cross-sectional view of the speaker device 100, which is cut by a cutting line A-A' passing through a central axis L1 of the speaker device 100 in FIGS. 1A and 1B.

The speaker device 100 mainly includes: an internal magnet type magnetic circuit 30 having a yoke 1, a magnet 2 and a plate 3; a vibration body 31 having a voice coil bobbin 5, a voice coil 6, a damper 7 and a diaphragm 8; a frame (supporting body) 4; and other components. As the other components, there are a sound absorbing material 9, a capacitor 10 as an example of an electronic component, speaker terminals 11*a* and 11*b* and an annular member 12. As the electronic components, there are not only the capacitor but also a coil and a resistor. Each of the electronic components has a function to control a frequency component of a sound signal inputted to the voice coil via wiring (not shown) of an amplifier and a function to adjust an input level of the sound signal. In the present invention, the shape and driving method of the speaker device 100 are not limited.

(Configuration of Magnetic Circuit)

Now, a description will be given of a configuration of a magnetic circuit 30.

The yoke 1, having a flat plate bottom part and a cylindrical part formed to extend to an acoustic radiation direction Y1 from the bottom part, is mounted on a mounting part 41 of the frame 4, which will be explained later. The magnet 2, having a plate shape, is mounted on the bottom surface of the yoke 1. The plate 3, having an annular shape, is mounted on the magnet 2. A magnetic gap 32 on which a magnetic flux of the magnet 2 concentrates is formed between the outer peripheral surface of the plate 3 and the inner peripheral surface of the upper end part of the yoke 1.

(Configuration of Vibration Body)

The vibration body 31 includes the voice coil bobbin 5, the voice coil 6, the damper 7 and the diaphragm 8 as components, which will be explained below.

The voice coil bobbin 5 having a cylindrical shape is arranged to surround the plate 3, the damper 7 and the sound absorbing material 9.

The voice coil 6, wounded around an outer peripheral surface of a lower end part of the voice coil bobbin 5, is positioned in the magnetic gap 32. The voice coil 6 has a pair of positive/negative lead wires 6*a* and 6*b*. The lead wire 6*a* on the positive side serves as input wiring for an L (or R) channel signal, and the lead wire 6*b* on the negative side serves as input wiring for a ground (GND: earth) signal.

The damper 7, made by a material in a film state, includes a first member 71 having a plate shape, and a second member 72 provided to project on the side of the plate 3 from a lower end surface 71*a* of the first member 71. The first member 71 is arranged opposite to the plate 3, and the second member 72 is mounted on the plate 3. Further, the outer peripheral part of the first member 71 is mounted on the inner peripheral surface of the voice coil bobbin 5. Thereby, at the time of driving the speaker device 100, a movable part 71*m* of the damper 7, which is formed between the outer peripheral part of the first member 71 and the second member 72 moves with respect to a bent part 73 formed between the movable part 71*m* and the second member 72 with the movement of the voice coil bobbin 5 in the direction of the central axis L1.

The diaphragm 8 having a dome shape is preferably made by a woven cloth and a nonwoven cloth made by fiber, and a fabric material in a sheet state formed by attaching an adhesive such as a resin to the woven cloth and the nonwoven cloth. The diaphragm 8 has a sound outputting part 8*a* having a function to output a sound wave in an acoustic radiation direction Y1, and an edge 8*b* which is formed to outwardly extend from the outer peripheral part of the sound outputting part 8*a* and which has a cross-sectional shape of a substantially half circle. The outer peripheral part of the sound outputting part 8*a* is mounted on the outer peripheral surface of the upper end part of the voice coil bobbin 5, and the outer peripheral part of the edge 8*b* is mounted on a surface 43*y* of a flange part 43 of the frame 4.

(Configuration of Frame)

The frame 4 having a bowl shape has a function to support the magnetic circuit 30 and the vibration body 31. The frame 4 is preferably made by a resin material. Thereby, forming of the frame 4 becomes easy. The detailed configuration of the frame 4 will be explained later.

(Configurations of Other Components)

As the other components, there are the sound absorbing material 9, the capacitor 10, the speaker terminals 11*a* and 11*b* and the annular member 12, and configurations thereof will be described below.

The sound absorbing material 9, having permeability, is mounted on the upper end surface 71*b* of the first member 71 of the damper 7. At the time of driving the speaker device 100, the sound absorbing material 9 absorbs most of the unnecessary sound wave occurring on the back side (on the side reverse to the acoustic radiation direction Y1) of the sound outputting part 8*a* of the diaphragm 8. Namely, the sound absorbing material 9 has a function to prevent deterioration of sound quality.

The capacitor 10 has a pair of lead wires (conductive wires) 10*a* and 10*b*, which are fixed to a capacitor fixing part 43*b* of the frame 4. In this embodiment, only the single capacitor fixing part 43*b* is provided, but plural capacitor fixing parts 43*b* may be provided in the present invention. The capacitor 10 has a function to mainly get the sound signal having a specific frequency out of the sound signals inputted to the voice coil 6 via the wiring of the amplifier.

The speaker terminals 11*a* and 11*b*, having a substantial L shape, are mounted on the speaker terminal mounting parts 43*a* and 43*b* of the frame 4, respectively.

The annular member 12, having a substantially annular shape, is mounted on an edge 8*b* of the diaphragm 8. The annular member 12 sandwiches the edge 8*b* with the frame 4, and supports the diaphragm 8. The annular member 12 has a pair of penetration holes 12*h* to draw the pair of lead wires 6*a* and 6*b* drawn from the voice coil 6 toward the acoustic radiation direction Y1 and the outer side. One of the penetration holes 12*h* is provided in the vicinity of the speaker terminal 11*a*, and the other one of the penetration holes 12*h* is provided at a position corresponding to the first lead wire guide part 43*ga* of the frame 4.

(Configuration of Wiring Circuit of Speaker Device)

Next, a description will be given of the configuration of the wiring circuit of the speaker device 100 with reference to FIGS. 1A and 1B to FIG. 3. FIG. 3 schematically shows a wiring circuit 90 of the speaker device 100.

The speaker device 100 includes the capacitor 10 and a speaker main body 60 (including a vibration body 31, the magnetic circuit 30 and the frame 4) between the speaker terminals 11*a* and 11*b*, which are connected in series.

Concretely, when the wiring circuit 90 shown in FIGS. 1A and 1B and FIG. 3 is observed along an arrow direction, in the speaker device 100, the lead wire 10*b* of the capacitor 10 is connected to the speaker terminal 11*b* in series, and the lead wire 10*a* of the capacitor 10 is connected to the positive lead wire 6*a* of the voice coil 6 in series. Further, the negative lead wire 6*b* of the voice coil 6 is connected to the speaker terminal 11*a* in series. The positive wiring of the amplifier is connected to the speaker terminal 11*b*, and the negative wiring of the amplifier is connected to the speaker terminal 11*a*, which are not illustrated. In the present invention, the negative wiring of the amplifier may be connected to the speaker terminal 11*b*, and the positive wiring of the amplifier may be connected to the speaker terminal 11*a*. However, in this case, the lead wire 6*a* of the voice coil 6 serves as the negative input wiring, and the lead wire 6*b* of the voice coil 6 serves as the positive input wiring.

In the speaker device 100 having the above configuration, the sound current outputted from the wiring of the amplifier is inputted to the voice coil 6 via the speaker terminals 11*a* and 11*b*, the pair of lead wires 10*a* and 10*b* of the capacitor 10 and the pair of positive/negative lead wires 6*a* and 6*b* of the voice coil 6. Thereby, based on Fleming's left-hand rule, an electromagnetic force (Lorentz's force) operates on the voice coil 6 in the magnetic gap 32. Then, the voice coil 6 and the diaphragm 8 move together in the acoustic radiation direction Y1 and the reverse direction. Thereby, the sound wave is outputted in the acoustic radiation direction Y1 via the sound outputting part 8*a* of the diaphragm 8.

(Configuration of Connecting Lead Wire of Capacitor and Lead Wire of Voice Coil)

Before explaining a configuration of connecting the lead wire 10*a* of the capacitor 10 and the lead wire 6*a* of the voice coil 6, which is a characteristic of the embodiment, a description will be given of a detailed configuration of the frame 4 for supporting the wiring, with reference to FIGS. 1A and 1B to FIGS. 5A and 5B.

Figure 4B:
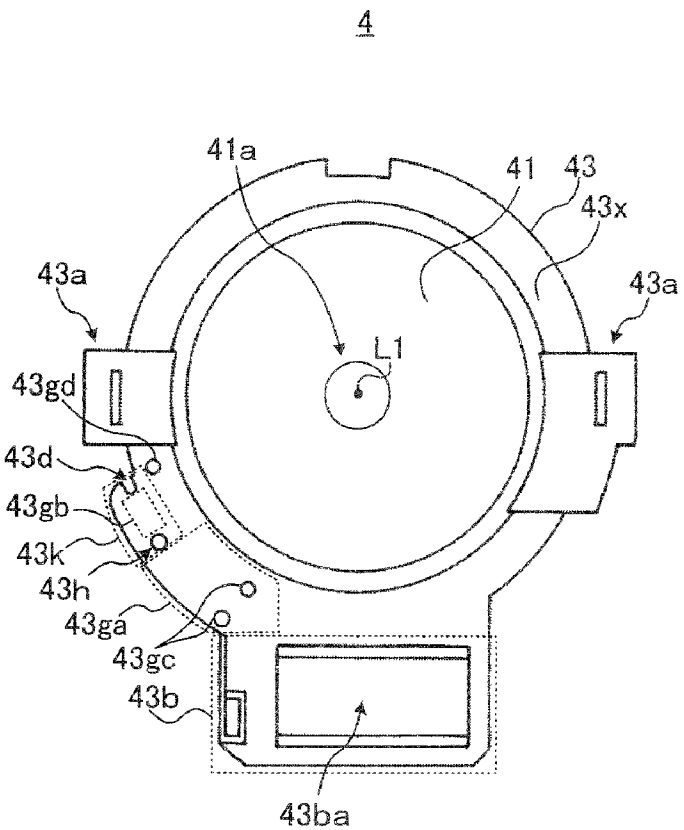
FIGS. 4A and 4B are a front view and a rear view of a frame according to the embodiment.
Figure 4A:
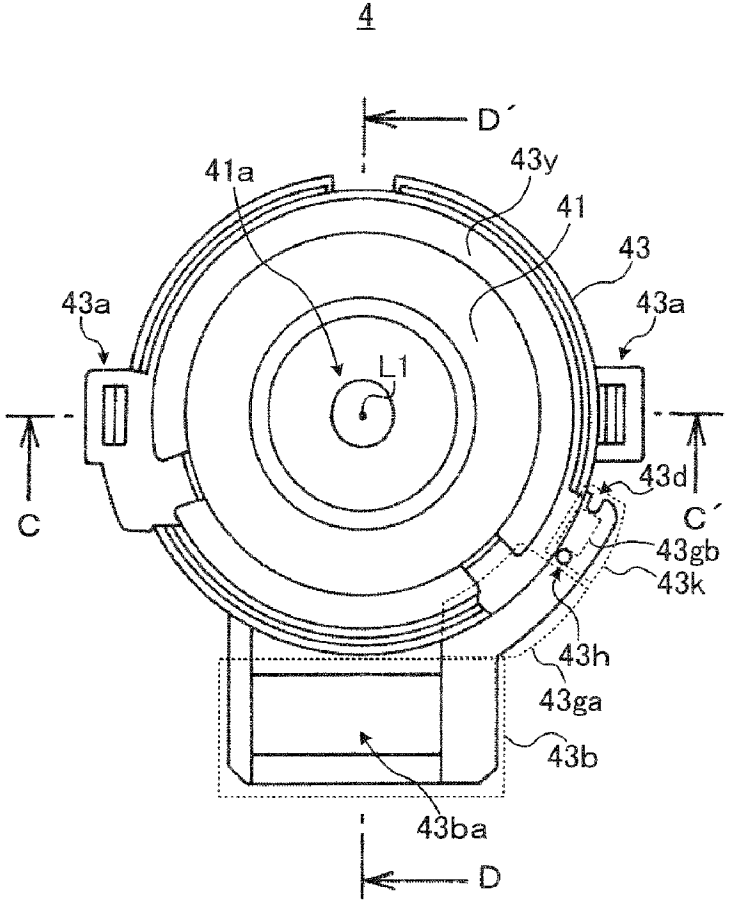
Figure 5B:
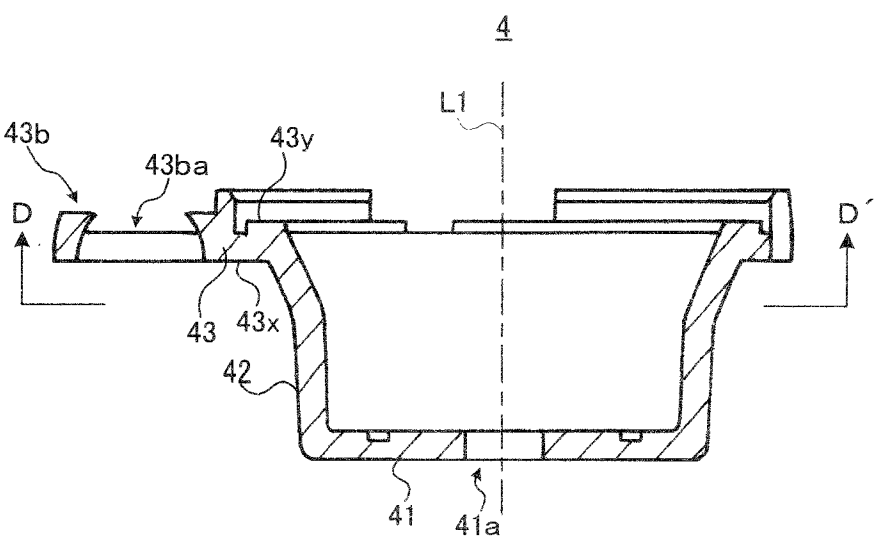
FIGS. 5A and 5B are various kinds of cross-sectional views of the frame according to the embodiment.
Figure 5A:
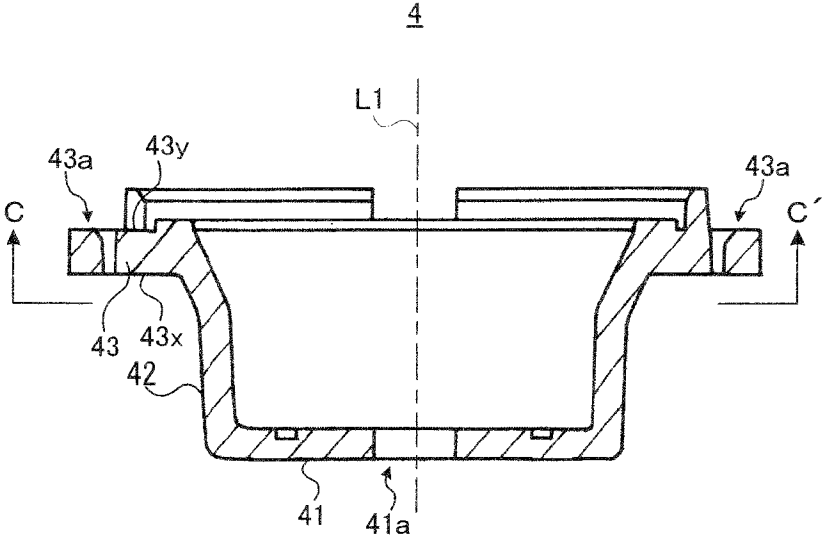

FIG. 4A shows a front view of the frame 4 positioned in the acoustic radiation direction Y1. FIG. 45 shows a rear view of the frame 4 positioned in the direction reverse to the acoustic radiation direction Y1. FIG. 5A shows a cross-sectional view along a cutting line C-C' passing through the central line L1 of the frame 4 shown in FIG. 4A, and it particularly shows a cross-sectional view when the frame 4 is cut at a position passing through plural speaker terminal mounting parts 43*a*. FIG. 5B shows a cross-sectional view along a cutting line D-D' passing through the central axis L1 of the frame 4 shown in FIG. 4A, and it particularly shows a cross-sectional view when the frame 4 is cut at a position passing through the capacitor fixing part 43*b* to which the capacitor 10 is fixed.

The basic configuration of the frame 4 is described above. The frame 4 includes a plate-shaped mounting part 41, a cylindrical part 42 which extends to the acoustic radiation direction Y1 from the outer peripheral part of the mounting part 41, and a brim-shaped flange part 43 which extends to the direction substantially orthogonal to the central axis L1 and on the outer side with respect to the upper end part of the cylindrical part 42.

Figure 2:
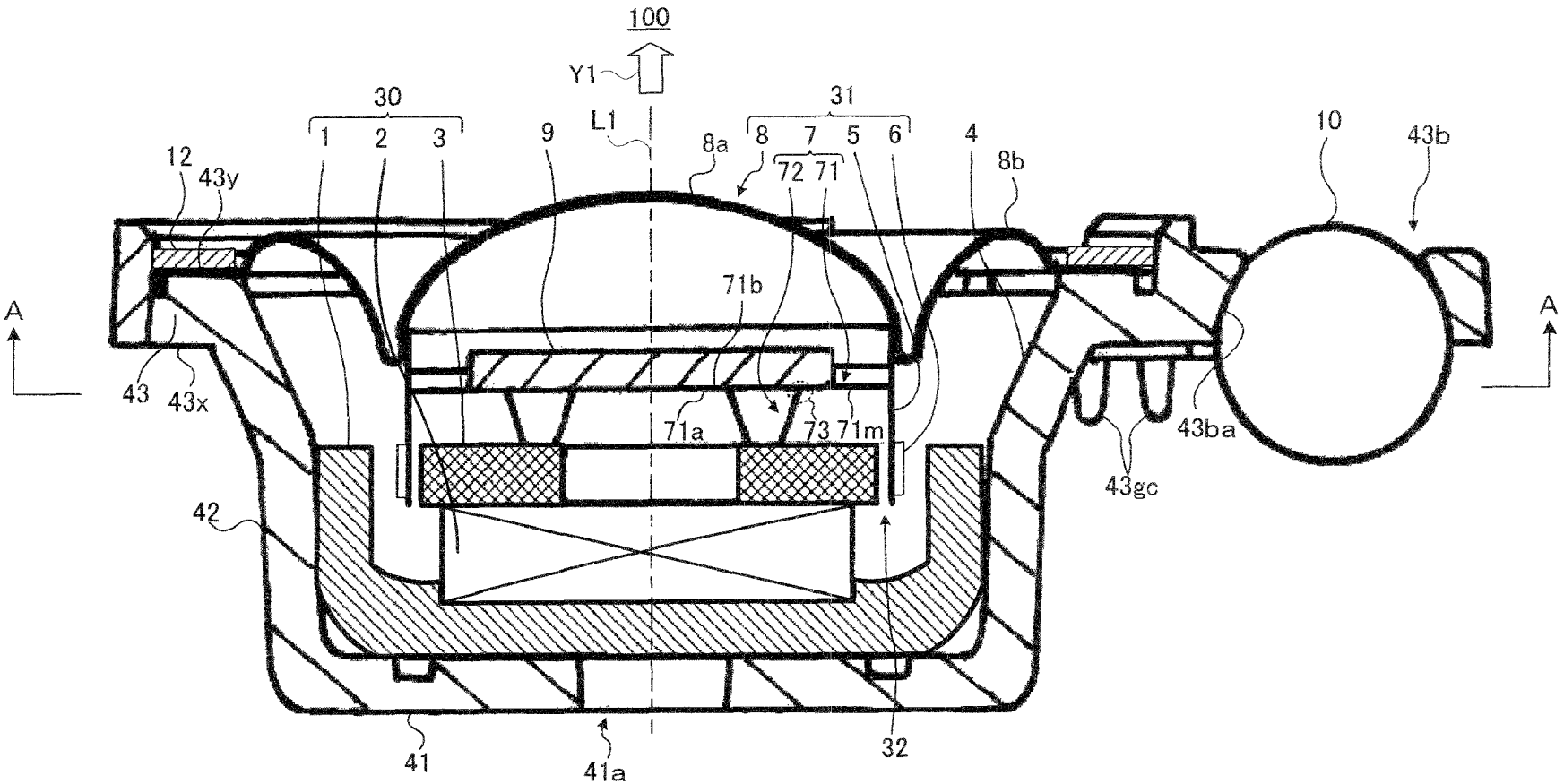
FIG. 2 is a cross-sectional view of the speaker device according to the embodiment.
Figure 3:
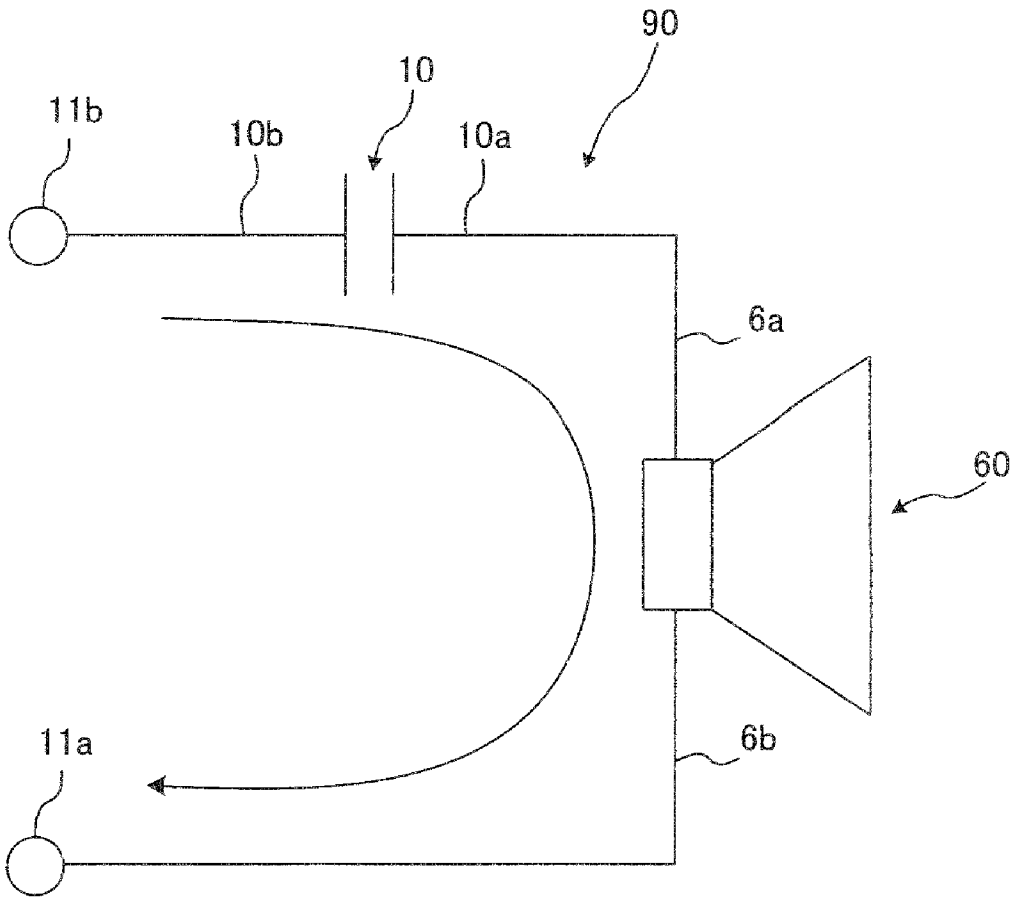
FIG. 3 is a wiring circuit view of the speaker device according to the embodiment.

As shown in FIG. 2, the magnetic circuit 30 is mounted on the mounting part 41. A penetration hole 41*a* penetrating in the direction of the central axis L1 is provided at the center of the mounting part 41. A penetration hole 41*a* has a function to emit the heat, generated in the voice coil 5 at the time of driving the speaker device 100, to the external via the magnetic circuit 30.

As shown in FIG. 2, the cylindrical part 42 surrounds the outer peripheral part of the magnetic circuit 30, and protects the magnetic circuit 30.

As shown in FIGS. 1A and 1B and FIG. 2, the flange part 43 has a function to support the outer peripheral part of the edge 8*b*, the capacitor 10, the lead wires 10*a* and 10*b* of the capacitor 10 and the speaker terminals 11*a* and 11*b*. The flange part 43 has: the plural speaker terminal mounting parts 43*a* on which the speaker terminals 11*a* and 11*b* are mounted; the capacitor fixing part 43*b* (an area surrounded by a rectangular-shaped broken line shown in FIGS. 4A and 4B) for fixing the capacitor 10; the lead wire fixing part 43*k* (the area surrounded by the rectangular-shaped broken line shown in FIGS. 4A and 4B) for fixing the lead wire 10*a* of the capacitor 10; and the first lead wire guide part 43*ga* (the area surrounded by the rectangular-shaped broken line shown in FIGS. 4A and 4B), provided between the capacitor fixing part 43*b* and the lead wire fixing part 43*k*, having a plate shape, for guiding the lead wire 10*a* of the capacitor 10 from the side of the capacitor fixing part 43*b* to the lead wire fixing part 43*k*.

Each of the speaker terminal mounting parts 43*a* is provided at a position opposite to each other at the flange part 43 of the frame 4. As shown in FIGS. 1A and 1B and FIG. 2, the speaker terminals 11*a* and 11*b* are mounted on the speaker terminal mounting parts 43*a*, respectively.

The capacitor fixing part 43*b* has an opening 43*ba* for accommodating the capacitor 10. As shown in FIGS. 1A and 1B and FIG. 2, the capacitor 10 is accommodated in the opening 43*ba* to be fixed to the capacitor fixing part 43*b* via an adhesive (not shown), for example.

The lead wire fixing part 43*k* has: an insertion hole 43*h* for inserting the lead wire 10*a* of the capacitor 10; a groove 43*d*, provided in the vicinity of the insertion hole 43*h*, for fixing a end portion 10*aa* (see FIG. 6B) of the lead wire 10*a* of the capacitor 10; and a second lead wire guide part 43*gb* (the area surrounded by the rectangular-shaped broken line shown in FIGS. 4A and 4B), provided between the insertion hole 43*h* and the groove 43*d*, having a plate shape, for guiding the lead wire 10*a* of the capacitor 10 from the insertion hole 43*h* to the groove 43*d*.

The insertion hole 43*h* penetrates in the direction of the central axis L1 and in the acoustic radiation direction Y1. The groove 43*d* is formed by cutting out one end of the lead wire fixing part 43*k*. The groove 43*d* and the insertion hole 43*h* sandwich the second lead wire guide part 43*gb* to be arranged opposite to each other.

As shown in FIG. 2 and FIG. 4A, a pair of projecting bent parts 43*gc* for bending the lead wires 10*a* and 10*b* drawn from the capacitor 10 in a predetermined direction, on a back surface 43*x* of the first lead wire guide part 43*ga* positioned on the side reverse to the acoustic radiation direction Y1. Each of the bent parts 43*gc* is arranged with a predetermined space therebetween. In the present invention, each of the bent parts 43*gc* may be arranged with a predetermined space on the back surface 43*x* of the capacitor fixing part 43*b*. Each of the bent parts 43*gc* is arranged with the predetermined space, which prevents a short circuit of the lead wires 10*a* and 10*b* of the capacitor 10. A projecting guide part 43*gd* for guiding the lead wire 10*b* of the capacitor 10 to the speaker terminal mounting part 43*a* is provided on the back surface 43*x* of the flange part 43 positioned on the side reverse to the acoustic radiation direction Y1 and in the vicinity of the lead wire fixing part 43*k*.

Next, a description will be given, of the connection configuration of the lead wires 10*a* of the capacitor 10 and the lead wire 6*a* of the voice coil bobbin 6 which is the characteristic of the embodiment, with reference to FIGS. 1R and 1B and FIGS. 6A and 6B.

Figure 6B:
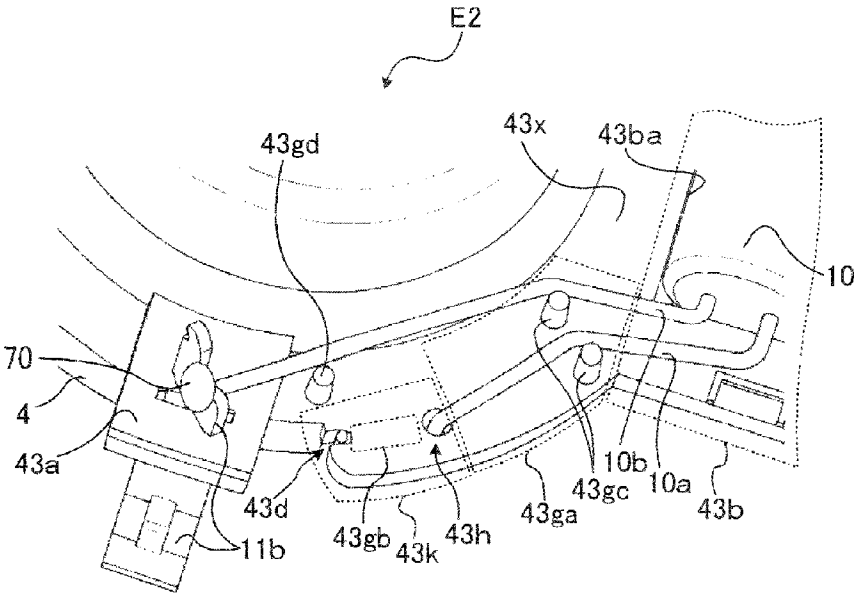
FIGS. 6A and 6B are various kinds of perspective views of an enlarged main point showing a wiring configuration of the speaker device according to the embodiment.
Figure 6A:
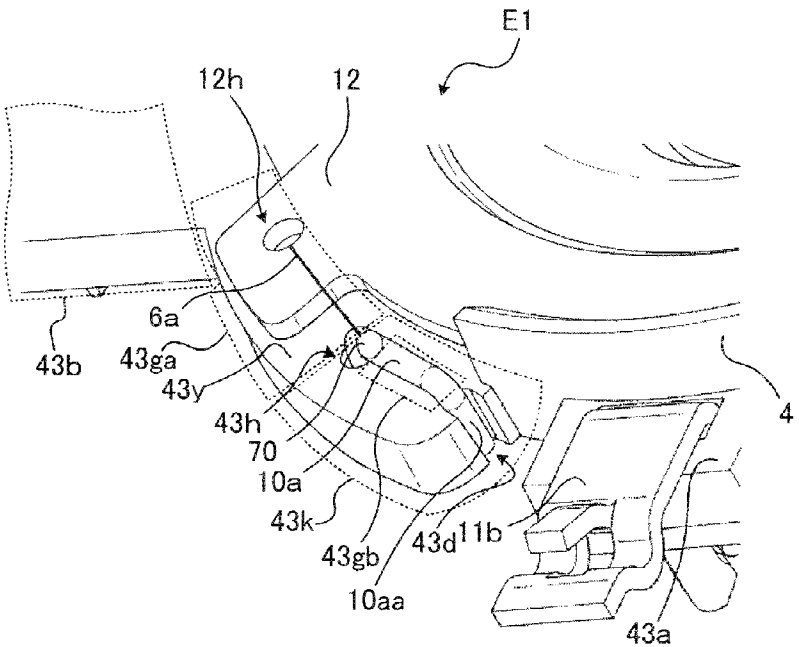

FIG. 6A shows the fixing configuration of the lead wire 10*a* of the capacitor 10 and the connection configuration of the lead wire 10*a* of the capacitor 10 and the lead wire 6*a* of the voice coil 6, when the vicinity of the broken-lined area E1 shown in FIG. 1A is observed from the different angle. FIG. 6B shows the fixing configuration of the lead wire 10*a* of the capacitor 10 corresponding to the vicinity of the broken-lined area 52 shown in FIG. 1B.

Hereinafter, the pair of lead wires 10*a* and 10*b* drawn from the capacitor 10 will be explained. First, a description will be given of the fixing configuration of the lead wire 10*a* of the capacitor 10 at the lead wire fixing part 43*k*, and next, a description will be given of the connection configuration of the lead wire 10*a* of the capacitor 10 and the lead wire 6*a* of the voice coil 6.

Now, the fixing configuration of the lead wire 10*a* of the capacitor 10 at the lead wire fixing part 43*k* will be explained.

The capacitor 10 accommodated in the opening 43*ba* is fixed to the capacitor fixing part 43*b*. The lead wire 10*a* drawn from the capacitor 10 is guided from the back surface 43*x* of the capacitor fixing part 43*b* to the bent part 43*gc* positioned on the outside with respect to the central axis L1, of the pair of the bent parts 43*gc* provided on the back surface 43*x* of the first lead wire guide part 43*ga*. Then, the lead wire 10*a* is outwardly bent at the one of the bent parts 43*gc*, and is further guided to the insertion hole 43*h* along the back surface 43*x* of the first lead wire guide part 43*ga*. The lead wire 10*a* of the capacitor 10 is bent in the acoustic radiation direction Y1 to be inserted to the insertion hole 43*h*, and is drawn to the surface 43*y* of the second lead wire guide part 43*gb*, positioned in the acoustic radiation direction Y1, to be guided to the groove 43*d* along the surface 43*y* of the second lead wire guide part 43*gb*. The end portion 10*aa* of the lead wire 10*a* of the capacitor 10 is bent in the direction reverse to the acoustic radiation direction Y1 to be fixed to the groove 43*d*. Therefore, the lead wire 10*a* of the capacitor 10 is fixed to the insertion hole 43*h* and the groove 43*d* opposite to the insertion hole 43*h*, both of which sandwich the second lead wire guide part 43*gb*.

The fixing configuration of the lead wire 10*a* of the capacitor 10 at the above-mentioned lead wire fixing part 43*k* may be reinforced via the adhesive so that the lead wire 10*a* of the capacitor 10 is more strongly fixed to the lead wire fixing part 43*k*.

In a preferable example, the lead wire 10*a* of the capacitor 10, positioned on the back surface 43*x* of the capacitor fixing part 43*b* and/or the back surface 43*x* of the first lead wire guide part 43*ga*, is preferably fixed via an adhesive (not shown) applied to the back surface 43*x* of the capacitor fixing part 43*b* and/or the back surface 43*x* of the first lead wire guide part 43*ga*. Thereby, it becomes possible to enhance the joint force between the back surface 43*x* of the capacitor fixing part 43*b* and/or the back surface 43*x* of the first lead wire guide part 43*ga* and the lead wire 10*a* of the capacitor 10.

In addition, it is preferable that the adhesive (not shown) is applied to the insertion hole 43*h* and the lead wire 10*a* of the capacitor 10 positioned at the insertion hole 43*h* is fixed into the insertion hole 43*h* via the adhesive. Thereby, it becomes possible to enhance the joint force between the insertion hole 43*h* and the lead wire 10*a* of the capacitor 10.

In addition, the lead wire 10*a* of the capacitor 10 positioned on the surface 43*y* of the second lead wire guide part 43*gb* is preferably fixed by the adhesive (not shown) applied to the surface 43*y* of the second lead wire guide part 43*gb*. Thereby, it becomes possible to enhance the joint force between the surface 43*y* of the second lead wire guide part 43*gb* and the lead wire 10*a* of the capacitor 10.

The lead wire 10*a* of the capacitor 10, positioned in the groove 43*d*, is preferably fixed by the adhesive (not shown) applied to the groove 43*d*. Thereby, it becomes possible to enhance the joint force between the groove 43*d* and the lead wire 10*a* of the capacitor 10.

Next, a description will be given of the connection configuration of the lead wire 10*a* of the capacitor 10 and the lead wire 6*a* of the voice coil 6, below.

The lead wire 6*a* drawn from the voice coil 6 is inserted into the penetration hole 12*h* of the annular member 12 to be directed to the acoustic radiation direction Y1. Further, the lead wire 6*a* is drawn to the surface 43*y* of the second lead wire guide part 43*gb*. Then, the end portion of the lead wire 6*a* of the voice coil 6 is directly and electrically connected to the lead wire 10*a* of the capacitor 10 drawn to the surface 43*y* of the second lead wire guide part 43*gb*. In addition, the connection part between the end portion of the lead wire 6*a* of the voice coil 6 and the lead wire 10*a* of the capacitor 10 are soldered by a solder 70.

The wiring configuration of the lead wire 10*b* of the capacitor 10 will be explained below.

The lead wire 10*b* drawn from the capacitor 10 is guided to the other bent part 43*gc* positioned on the side of the central axis L1, of the pair of bent parts 43*gc* provided on the back surface 43*x* of the first lead wire guide part 43*ga* from the back surface 43*x* of the capacitor fixing part 43*b*, and is outwardly bent at the other bent part 43*gc* to be guided to the projecting guide part 43*gd* along the back surface 43*x* of the flange part 43 positioned in the vicinity of the first lead wire guide part 43*ga*. Then, the lead wire 10*b*, supported by the projecting guide part 43*gd*, is guided to the speaker terminal mounting part 43*a* to be electrically connected to the speaker terminal 11*b* mounted on the speaker terminal mounting part 43*a*.

Next, a description will be given of the speaker device 100 having the connection configuration between the lead wire 10*a* of the capacitor 10 and the lead wire 6*a* of the voice coil 6, which is the characteristic of the embodiment.

In the speaker device 100 according to the embodiment of the present invention, the frame 4 has the lead wire fixing part 43*k* for fixing the lead wire 10*a* drawn from the capacitor 10, and the lead wire 10*a* of the capacitor 10 is fixed to the lead wire fixing part 43*k* to be directly and electrically connected to the lead wire 6*a* of the voice coil 6.

Thereby, even if the vibration is transmitted to the frame 4 at the time of driving the speaker device 100, the lead wire 10*a* of the capacitor 10 never vibrates or moves. Therefore, it can be prevented that the lead wire 10*a* of the capacitor 10 pulls the lead wire 6*a* of the voice coil 6. Thus, it can be prevented that the lead wire 10*a* of the capacitor 10 and the lead wire 6*a* of the voice coil 6 are cut. In addition, since the lead wire 6*a* of the voice coil 6 is never pulled on the side of the lead wire 10*a* of the capacitor 10, it can be also prevented that the voice coil 6 is pulled on the side of the lead wire 10*a* of the capacitor 10. Hence, it can be suppressed that the movement of the voice coil 6 (vibration occurring when the sound current is inputted) is prevented at the time of driving the speaker device 100.

In the configuration, the lead wire 10*a* of the capacitor 10 serves as the speaker terminal lug, and it becomes possible to electrically connect the lead wire 10*a* of the capacitor 10 and the lead wire 6*a* of the voice coil 6 without the speaker terminal lug included in the speaker device according to Patent References-1 to 3. Thereby, the cost of the speaker device 100 can be reduced by the cost of the additional terminal lug.

In this embodiment, the capacitor 10 is fixed to the capacitor fixing part 43*b*. Therefore, even if the vibration is transmitted to the frame 4 at the time of driving the speaker device 100, the capacitor 10 never pulls the lead wire 10*a* of the capacitor 10. Thus, the lead wire 10*a* of the capacitor 10 never vibrates or moves. Thereby, it can be prevented that the lead wire 10*a* of the capacitor 10 pulls the lead wire 6*a* of the voice coil 6.

In addition, in this embodiment, the lead wire 10*a* drawn from the capacitor 10 is guided into the insertion hole 43*h* along the back surface 43*x* of the first lead wire guide part 43*ga*, positioned in the direction reverse to the acoustic radiation direction Y1, and is bent in the acoustic radiation direction Y1 to be inserted to the insertion hole 43*h*. Then, the lead wire 10*a* is drawn to the surface 43*y* of the second lead wire guide part 43*gb*, positioned in the acoustic radiation direction Y1, and is guided into the groove 43*d* along the surface 43*y* of the second lead wire guide part 43*gb*. The end portion 10*aa* of the lead wire 10*a* of the capacitor 10 is bent in the direction reverse to the acoustic radiation direction Y1 to be fixed into the groove 43*d*. In a preferred example, the lead wire 6*a* of the voice coil 6 is directly and electrically connected to the part of the lead wire 10*a* of the capacitor 10 drawn to the surface 43*y* of the second lead wire guide part 43*gb*.

The lead wire 10*a* of the capacitor 10 is fixed by the insertion hole 43*h* and the groove 43*d* arranged opposite to the insertion hole 43*h*, both of which sandwich the second lead wire guide part 43*gb*. Thereby, even if the vibration is transmitted to the frame 4 at the time of driving the speaker device 100, the lead wire 10*a* of the capacitor 10 never vibrates or moves. Therefore, it can be prevented that the lead wire 10*a* of the capacitor 10 pulls the lead wire 6*a* of the voice coil 6.

In this embodiment, the lead wire 10*a* drawn from the capacitor 10 is guided to the bent part 43*gc* positioned on the outside with respect to the central axis L1, of the pair of bent parts 43*gc* provided on the back surface 43*x* of the first lead wire guide part 43*ga* from the back surface 43*x* of the capacitor fixing part 43*b*, and is bent on the outside at the bent part 43*gc*. Further, the lead wire 10*a* is guided to the insertion hole 43*h* along the back surface 43*x* of the first lead wire guide part 43*ga*. Thereby, even when, in some shapes of the flange part 43 of the frame 4, the lead wire 10*a* drawn from the capacitor 10, straightly extending, cannot be guided to the insertion hole 43*h* because of probability of the short circuit with the lead wire 10*a*, it becomes possible that the lead wire 10*a* drawn from the capacitor 10 is bent in the direction of the insertion hole 43*h* at the bent part 43*gc* and is rounded to be securely guided into the insertion hole 43*h*.

In addition, since the lead wire 10*a* drawn from the capacitor 10 contacts the bent part 43*gc* and is bent, it can be prevented that the vibration energy to the capacitor fixing part 43*b* is transmitted by dispersing the vibration energy transmitted from a tinsel cord (not shown) and the frame 4 to the bent part 43*gc*, it can be suppressed that the vibration energy is transmitted to the capacitor fixing part 43*b*. Further, it can be suppressed that the capacitor 10 slips out of the capacitor fixing part 43*b*.

In this embodiment, the capacitor 10 has the pair of lead wires 10*a* and 10*b*, and the pair of bent parts 43*gc* are provided on the back surface 43*x* of the first lead wire guide part 43*ga* with the predetermined space. The lead wire 10*a* of the capacitor 10 is bent on the outside at the bent part 43*gc* positioned on the outside with respect to the central axis L1. Further, the lead wire 10*a* is guided to the insertion hole 43*h* along the back surface 43*x* of the first lead wire guide part 43*ga* with the predetermined space with respect to the lead wire 10*b* of the capacitor 10. Meanwhile, the lead wire 10*b* of the capacitor 10 is bent on the outside at the other bent part 43*gc* positioned on the side of the central axis L1, and is guided to the projecting guide part 43*gd* along the back surface 43*x* of the flange part 43, positioned in the vicinity of the first lead wire guide part 43*ga* with the predetermined space with respect to the lead wire 10*a* of the capacitor 10. Therefore, the short circuit between the lead wire 6*a* of the voice coil 6 and the lead wire 10*b* of the capacitor 10 can be prevented by the pair of bent parts 43*gc* provided with the predetermined space.

The lead wire 10*b* drawn from the capacitor 10 contacts the bent part 43*gc* and the projecting guide part 43*gd*, and is bent. Therefore, by dispersing the vibration energy transmitted from the tinsel cord (not shown) and the frame 4 to the bent part 43*gc* and the projecting guide part 43*gd*, it can be suppressed that the vibration energy is transmitted to the capacitor fixing part 43*b*. It can also be suppressed that the capacitor 10 slips out of the capacitor fixing part 43*b*. It can be further suppressed that the joint force with the speaker terminal 11*b* weakens and wiring cut occurs.

In this embodiment, the connection part between the lead wire 10*a* of the capacitor 10 and the lead wire 6*a* of the voice coil 6 is preferably soldered. Thereby, it securely becomes possible that the lead wire 6*a* of the voice coil 6 is electrically connected to the lead wire 10*a* of the capacitor 10.

In the present invention, by applying the wiring configuration of the lead wire 6*a* of the voice coil 6 according to the above-mentioned embodiment to the tinsel cord (not shown) electrically connected to the lead wire 6*a* of the voice coil 6, the lead wire 10*a* of the capacitor 10 and the tinsel cord may be directly and electrically connected.

Also, in the present invention, by providing a guide part (e.g., a groove) for guiding the lead wire 10*a* of the capacitor 10 on the back surface 43*x* of the capacitor fixing part 43*b*, the surface 43*y* or the back surface 43*x* of the first lead wire guide part 43*ga*, and the surface 43*y* of the second lead wire guide part 43*gb*, the lead wire 10*a* of the capacitor 10 may be guided.

In this embodiment, the frame 4 has only the capacitor fixing part 43*b*, but the present invention is not limited to this. Namely, in the present invention, the frame 4 may have a coil fixing part for fixing various kinds of coils and a resistor fixing part for fixing various kinds of resistors, in addition to the capacitor fixing part 43*b*.

In this case, the frame 4 has the lead wire fixing part (corresponding to the lead wire fixing part 43*k*) for fixing the lead wire (not shown) drawn from the various kinds of coils or the resistors, and the lead wire of the various kinds of coils or resistors is fixed to the lead wire fixing part to be directly and electrically connected to the lead wire 6*a* of the voice coil 6.

Thereby, even if the vibration is transmitted to the frame 4 at the time of driving the speaker device 100, the lead wire of the various kinds of coils or resistors never vibrates or moves. Thus, it can be prevented that the lead wire of the various kinds of coils or resistors pulls the lead wire 6*a* of the voice coil 6. Hence, it can be prevented that the lead wire of the various kinds of coils or resistors and the lead wire 6*a* of the voice coil 6 are cut. In addition, since the lead wire 6*a* of the voice coil 6 is never pulled on the side of the lead wire of the various kinds of coils or resistors, it can be prevented that the voice coil 6 is pulled on the side of the lead wire of the various kinds of coils or resistors. Therefore, at the time of driving the speaker device 100, it can be suppressed that the movement (vibration occurring when the sound current is inputted) of the voice coil 6 is prevented.

In the configuration, since the lead wire of the various kinds of coils or resistors serves as the speaker terminal lug, it becomes unnecessary to provide the speaker terminal lug included in the speaker device according to Patent References-1 to 3. The lead wire of the various kinds of coils or resistors and the lead wire 6*a* of the voice coil 6 can be electrically connected. Thereby, the cost of the speaker device 100 can be reduced by the cost of the additional terminal lug.

In this embodiment, the various kinds of coils or resistors are fixed to the coil fixing part or the resistor fixing part, respectively. Hence, even if the vibration is transmitted to the frame 4 at the time of driving the speaker device 100, the various kinds of coils or resistors never pull the lead wire of the various kinds of coils or resistors. Therefore, the lead wire of the various kinds of coils or resistors never vibrates or moves. Thereby, it can be prevented that the lead wire of various kinds of coils or resistors pulls the lead wire 6*a* of the voice coil 6.

[Modification]

In some specifications of the speaker device, the insertion hole 43*h* can be formed at the lead wire fixing part 43*k* of the frame 4, but the groove 43*d* cannot be provided due to the limit of the space in some cases. In this case, by changing the shape of the insertion hole 43*h*, the lead wire 10*a* of the capacitor 10 can be fixed by only the insertion hole 43*h*.

Now, a description will be given of other form of the insertion hole 43*h* according to a modification, with reference to FIG. 7A. FIG. 7A is a cross-sectional view of a main part in the vicinity of the lead wire fixing hole (corresponding to the insertion hole 43*h*) of the lead wire fixing part 43*k*, according to a modification.

First, a configuration of the lead wire fixing hole 43*hx* according to the modification will be described below.

The lead wire fixing part 43*k* has the lead wire fixing hole 43*hx* for fixing the bent lead wire 10*a* of the capacitor 10. In the present invention, it is not necessary that the lead wire fixing hole 43*hx* is provided at the lead wire fixing part 43*k*. Namely, the lead wire fixing hole 43*hx* may be provided at any position at the flange part 43 of the frame 4. The lead wire fixing hole 43*hx* penetrates in the acoustic radiation direction Y1 (not shown; corresponding to the upper part in FIGS. 7A to 7C). The lead wire point supporting part 43*ha* (a part shown by a broken-lined area) for supporting the end portion 10*aa* of the lead wire 10*a* of the capacitor 10 is provided in the lead wire fixing hole 43*h*. The lead wire point supporting part 43*ha* has a step-state cross-section.

Next, a description will be given of the fixing configuration of the lead wire 10*a* of the capacitor 10 in the lead wire fixing hole 43*hx*.

The lead wire 10*a* drawn from the capacitor 10, which is bent in the lead wire fixing hole 43*hx*, is fixed into the lead wire fixing hole 43*hx*.

Concretely, the lead wire 10*a* drawn from the capacitor 10 is guided to the lead wire fixing hole 43*hx* along the back surface 43*x* of the lead wire fixing part 43*k*, positioned in the direction reverse to the acoustic radiation direction Y1, and is bent in the acoustic radiation direction Y1 to be inserted to the lead wire fixing hole 43*hx*. Further, the lead wire 10*a* is arranged in the lead wire fixing hole 43*hx* to form the projecting shape in the acoustic radiation direction Y1. Then, the end portion 10*aa* of the lead wire 10*a* of the capacitor 10 is supported by the lead wire point supporting part 43*ha* in the lead wire fixing hole 43*hx*. Thereby, the lead wire 10*a* of the capacitor 10 arranged in the lead wire fixing hole 43*hx* is fixed by the lead wire point supporting part 43*ha* and a surface 43*hb* opposite to the lead wire point supporting part 43*ha*.

Now, a description will be given of an example of the method of fixing the lead wire 10*a* of the capacitor 10 to the lead wire fixing hole 43*hx*, with reference to FIGS. 7B and 7C.

Figure 7B:
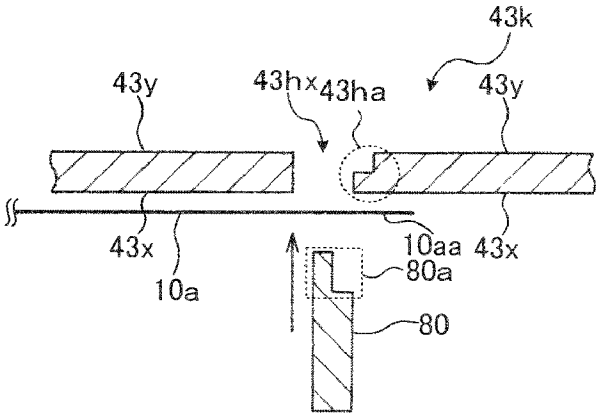
FIGS. 7A to 7C are various kinds of cross-sectional views showing the wiring configuration and a wiring method of a speaker device according to a modification.
Figure 7C:
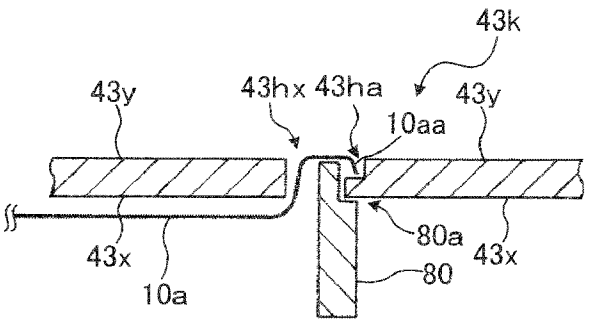
Figure 7A:
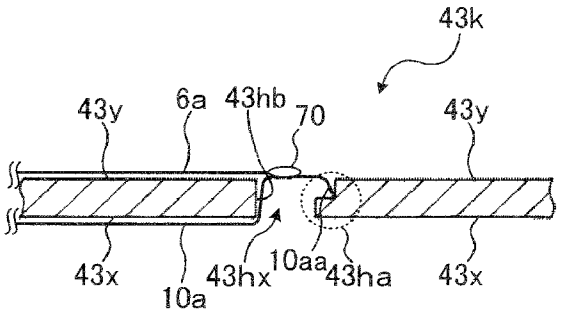

First, as shown in FIG. 7B, the lead wire 10*a* drawn from the capacitor 10 extends along the back surface 43*x* of the lead wire fixing part 43*k* to step over the lead wire fixing hole 43*hx*. Next, as shown in FIG. 7B, a jig 80, which has a end portion 80*a* having a step-state cross-section and able to be inserted into the lead wire fixing hole 43*hx*, is prepared. Then, as the jig 80 is made to move in an arrow direction (in the acoustic radiation direction Y1), the jig 80 is inserted into the lead wire fixing hole 43*hx* so that the end portion 80*a* and the lead wire point supporting part 43*ha* engage with each other, as shown in FIG. 7B. Next, the jig 80 is withdrawn from the lead wire fixing hole 43*hx* to the direction reverse to the acoustic radiation direction Y1. Thereby, the lead wire 10*a* of the capacitor 10 is fixed into the lead wire fixing hole 43*hx* to form the projecting shape in the acoustic radiation direction Y1. According to this method, the lead wire 10*a* of the capacitor 10 can be easily fixed into the lead wire fixing hole 43*hx*.

Next, the connection configuration of the lead wire 10*a* of the capacitor 10 and the lead wire 6*a* of the voice coil 6 will be explained below.

The lead wire 10*a* of the capacitor 10 exposed on the side of the surface 43*y* of the lead wire fixing part 43*k*, positioned in the acoustic radiation direction Y1, is directly and electrically connected to the lead wire 6*a* drawn from the voice coil 6 at the position corresponding to the lead wire fixing hole 43*hx*. In the modification, the drawing direction of the lead wire 6*a* of the voice coil 6 is same as that of the lead wire 10*a* of the capacitor 10. However, the drawing directions of them may be different. In addition, the connection part between the lead wire 10*a* of the capacitor 10 and the lead wire 6*a* of the voice coil 6 are soldered.

In the modification, the lead wire 10*a* of the capacitor 10 is fixed into the lead wire fixing hole 43*hx* by the lead wire point supporting part 43*ha* and the surface 43*hb* opposite to the lead wire point supporting part 43*ha*. Further, the lead wire 10*a* of the capacitor 10 exposed on the surface 43*y* of the lead wire fixing part 43*k* is directly and electrically connected to the lead wire 6*a* of the voice coil 6 at the position corresponding to the lead wire fixing hole 43*hx*.

Thereby, even when the space of the lead wire fixing part 43*k* is not enough, the lead wire 10*a* of the capacitor 10 can be securely fixed into the lead wire fixing hole 43*hx*.

In the configuration, since the lead wire 10*a* of the capacitor 10 serves as the speaker terminal lug, it becomes unnecessary to provide the speaker terminal lug included in the speaker device according to Patent References-1 to 3. Thus, the lead wire 10*a* of the capacitor 10 and the lead wire 6*a* of the voice coil 6 can be electrically connected. Thereby, the cost of the speaker device 100 can be reduced by the cost of the additional terminal lug.

In the configuration, even if the vibration is transmitted to the frame 4 at the time of driving the speaker device 100, the lead wire 10*a* of the capacitor 10 never vibrates or moves. Therefore, it can be prevented that the lead wire 10*a* of the capacitor 10 pulls the lead wire 6*a* of the voice coil 6. Hence, it can be prevented that the lead wire 10*a* of the capacitor 10 and the lead wire 6*a* of the voice coil 6 are cut. In addition, since the lead wire 6*a* of the voice coil 6 is not pulled on the side of the lead wire 10*a* of the capacitor 10, it can be prevented that the voice coil 6 is pulled on the side of the lead wire 10*a* of the capacitor 10. Thus, at the time of driving the speaker device 100, it can be suppressed that the appropriate movement of the voice coil 6 is prevented.

INDUSTRIAL APPLICABILITY

This invention can be used as an on-vehicle speaker, a speaker for mobile electronics and/or an indoor speaker.

The invention claimed is:

1. A speaker device, comprising: a wiring electrically connected to a voice coil; an electronic component having a conductive wire; and a supporting body for supporting the electronic component, wherein the supporting body has conductive wire fixing part for fixing the conductive wire of the electronic component, wherein the conductive wire of the electronic component is fixed to the conductive wire fixing part of the supporting body to be directly connected to the wiring.

2. The speaker device according to claim 1, wherein the supporting body includes plural electronic component fixing parts for fixing the electronic component, and wherein the electronic component is fixed to the electronic component fixing part.

3. The speaker device according to claim 1, wherein a first conductive wire guide part for guiding the conductive wire of the electronic component to the conductive wire fixing part is provided between the electronic component fixing part and the conductive wire fixing part, wherein the conductive wire fixing part has: an insertion hole for inserting the conductive wire; a groove for fixing a end portion of the conductive wire; and a second conductive wire guide part, provided between the insertion hole and the groove, for guiding the conductive wire from the insertion hole to the groove, wherein the insertion hole and the groove sandwich the second conductive wire guide part to face to each other, wherein the conductive wire drawn from the electronic component is guided to the insertion hole along a back surface of the first conductive wire guide part positioned in a direction reverse to the acoustic radiation direction; is bent in the acoustic radiation direction to be inserted to the insertion hole; is drawn to a surface of the second conductive wire guide part positioned in the acoustic radiation direction; and is guided to the groove along the surface of the second conductive wire guide part, and wherein the end portion of the conductive wire is bent in the direction reverse to the acoustic radiation direction to be fixed into the groove.

4. The speaker device according to claim 3, wherein the wiring is directly and electrically connected to the conductive wire of the electronic component drawn to the surface of the second conductive wire guide part.

5. The speaker device according to claim 3, wherein a projecting bent part for bending the conductive wire of the electronic component in a predetermined direction is provided on a back surface of the electronic component fixing part positioned in the direction reverse to the acoustic radiation direction or on the back surface of the first conductive wire guide part, and wherein the conductive wire drawn from the electronic component is bent in a direction of the insertion hole at the projecting bent part to be guided to the insertion hole along the back surface of the first conductive wire guide part.

6. The speaker device according to claim 3, wherein the electronic component has a pair of conductive wires, wherein a pair of projecting bent parts for bending the conductive wire of the electronic component in a predetermined direction are provided on the back surface of the electronic component fixing part positioned in the direction reverse to the acoustic radiation direction or on the back surface of the first conductive wire guide part, and wherein the pair of conductive wires drawn from the electronic component are bent in the predetermined direction at the pair of projecting bent parts, respectively.

7. The speaker device according to claim 1, wherein the conductive wire fixing part has a conductive wire fixing hole, penetrating in the acoustic radiation direction, for fixing the bent conductive wire of the electronic component, wherein a conductive wire supporting part, having a step-state cross-section and supporting the end portion of the conductive wire, is provided in the conductive wire fixing hole, wherein the conductive wire drawn from the electronic component is guided to the conductive wire fixing hole along the back surface of the electronic component fixing part positioned in the direction reverse to the acoustic radiation direction; is bent in the acoustic radiation direction to be inserted to the conductive wire fixing hole; and is arranged into the conductive wire fixing hole to form a projecting shape in the acoustic radiation direction, wherein the end portion of the conductive wire is supported by the conductive wire supporting part in the conductive wire fixing hole, wherein the conductive wire arranged in the conductive wire fixing hole is fixed by the conductive wire supporting part and a surface opposite to the conductive wire supporting part, and wherein the conductive wire of the electronic component positioned in the acoustic radiation direction is directly connected to the wiring of the voice coil at a position corresponding to the conductive wire fixing hole.

8. The speaker device according to claim 1, wherein a connection part between the conductive wire of the electronic component and the wiring of the voice coil is soldered.

9. The speaker device according to claim 3, wherein the conductive wire of the electronic component positioned in the insertion hole and/or the groove is fixed with an adhesive applied to the insertion hole and/or the groove.

10. The speaker device according to claim 1, wherein the supporting body is made by a resin material.

11. The speaker device according to claim 2, wherein a first conductive wire guide part for guiding the conductive wire of the electronic component to the conductive wire fixing part is provided between the electronic component fixing part and the conductive wire fixing part, wherein the conductive wire fixing part has: an insertion hole for inserting the conductive wire; a groove for fixing a end portion of the conductive wire; and a second conductive wire guide part, provided between the insertion hole and the groove, for guiding the conductive wire from the insertion hole to the groove, wherein the insertion hole and the groove sandwich the second conductive wire guide part to face to each other, wherein the conductive wire drawn from the electronic component is guided to the insertion hole along a back surface of the first conductive wire guide part positioned in a direction reverse to the acoustic radiation direction; is bent in the acoustic radiation direction to be inserted to the insertion hole; is drawn to a surface of the second conductive wire guide part positioned in the acoustic radiation direction; and is guided to the groove along the surface of the second conductive wire guide part, and wherein the end portion of the conductive wire is bent in the direction reverse to the acoustic radiation direction to be fixed into the groove.

12. The speaker device according to claim 4, wherein a projecting bent part for bending the conductive wire of the electronic component in a predetermined direction is provided on a back surface of the electronic component fixing part positioned in the direction reverse to the acoustic radiation direction or on the back surface of the first conductive wire guide part, and wherein the conductive wire drawn from the electronic component is bent in a direction of the insertion hole at the projecting bent part to be guided to the insertion hole along the back surface of the first conductive wire guide part.

13. The speaker device according to claim 4, wherein the electronic component has a pair of conductive wires, wherein a pair of projecting bent parts for bending the conductive wire of the electronic component in a predetermined direction are provided on the back surface of the electronic component fixing part positioned in the direction reverse to the acoustic radiation direction or on the back surface of the first conductive wire guide part, and wherein the pair of conductive wires drawn from the electronic component are bent in the predetermined direction at the pair of projecting bent parts, respectively.

14. The speaker device according to claim 4, wherein a connection part between the conductive wire of the electronic component and the wiring of the voice coil is soldered.

15. The speaker device according to claim 7, wherein a connection part between the conductive wire of the electronic component and the wiring of the voice coil is soldered.

* * * * *